US010174600B2

(12) United States Patent
Livescu et al.

(10) Patent No.: US 10,174,600 B2
(45) Date of Patent: Jan. 8, 2019

(54) REAL-TIME EXTENDED-REACH MONITORING AND OPTIMIZATION METHOD FOR COILED TUBING OPERATIONS

(71) Applicant: BAKER HUGHES INCORPORATED, Houston, TX (US)

(72) Inventors: Silviu Livescu, Calgary (CA); John G Misselbrook, Calgary (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 539 days.

(21) Appl. No.: 14/877,149

(22) Filed: Oct. 7, 2015

(65) Prior Publication Data

US 2016/0069146 A1 Mar. 10, 2016

Related U.S. Application Data

(63) Continuation-in-part of application No. 14/478,342, filed on Sep. 5, 2014, now abandoned.

(51) Int. Cl.
*E21B 19/22* (2006.01)
*E21B 31/00* (2006.01)
(Continued)

(52) U.S. Cl.
CPC ..... *E21B 43/25* (2013.01); *E21B 19/22* (2013.01); *E21B 31/005* (2013.01); *E21B 2023/008* (2013.01)

(58) Field of Classification Search
CPC ..... E21B 19/22; E21B 31/005; E21B 43/25; E21B 2023/008
See application file for complete search history.

(56) References Cited

U.S. PATENT DOCUMENTS 5,992,250 A * 11/1999 Kluth ..... E21B 17/003 254/134.4
8,272,404 B2 9/2012 Brunskill et al.
(Continued)

FOREIGN PATENT DOCUMENTS

WO WO03076760 A2 9/2003
WO 2005116388 A1 12/2005
WO 2013142179 A2 9/2013

OTHER PUBLICATIONS

Korean Intellectual Property Office; International Searching Authority; International Search Report and written Opinion for Application No. PCT/US2015/048943 dated Dec. 1, 2015.
(Continued)

*Primary Examiner* — Matthew R Buck
(74) *Attorney, Agent, or Firm* — Parsons Behle & Latimer

(57) ABSTRACT

A method of monitoring a coiled tubing operation includes positioning a bottom hole assembly (BHA) connected to a coiled tubing string within a horizontal wellbore. The method includes monitoring a plurality of sensors connected to the BHA via a communication line positioned within the coiled tubing string and determining an optimal injection speed of the coiled tubing string by monitoring the sensors in real-time. The injection speed of the coiled tubing may be changed based on the real-time determination of the optimal injection speed. The sensors may be monitored in real-time to determine an optimal amount of lubricant to be injected into a wellbore or whether the coiled tubing string is forming a helix. The BHA may include a tractor or a vibratory tool to aid in the movement of the BHA along a horizontal wellbore. The communication line may be used to power the sensors, tractor, and vibratory tool.

11 Claims, 11 Drawing Sheets

(51) Int. Cl.
*E21B 43/25* (2006.01)
*E21B 23/00* (2006.01)

(56) References Cited

U.S. PATENT DOCUMENTS

| | | | | |
|---|---|---|---|---|
| 2004/0159464 | A1 | 8/2004 | Von Gynz-rekowski | |
| 2007/0045006 | A1* | 3/2007 | Krueger | E21B 21/08 175/25 |
| 2008/0073076 | A1 | 3/2008 | O'Malley et al. | |
| 2009/0173543 | A1* | 7/2009 | Zupanick | E21B 3/02 175/57 |
| 2010/0170676 | A1 | 7/2010 | Misselbrook et al. | |
| 2012/0097398 | A1 | 4/2012 | Ravensbergen et al. | |
| 2012/0247778 | A1 | 10/2012 | Noles, Jr. et al. | |
| 2014/0126330 | A1* | 5/2014 | Shampine | E21B 47/0006 367/82 |
| 2014/0151043 | A1 | 6/2014 | Miller et al. | |
| 2014/0174722 | A1 | 6/2014 | Christie et al. | |
| 2015/0075783 | A1* | 3/2015 | Angman | E21B 43/26 166/250.01 |
| 2015/0159447 | A1* | 6/2015 | Miller | E21B 28/00 166/381 |
| 2017/0145760 | A1* | 5/2017 | Poyet | E21B 19/008 |

OTHER PUBLICATIONS

Korean International Property Office; International Search Report and Written Opinion for Application No. PCT/US2016/055259; dated Jan. 18, 2017.

U.S. Patent and Trademark Office; Office Action for U.S. Appl. No. 14/478,342 dated Sep. 25, 2015.

* cited by examiner

REAL-TIME EXTENDED-REACH MONITORING AND OPTIMIZATION METHOD FOR COILED TUBING OPERATIONS

RELATED APPLICATIONS

The present disclosure is a continuation-in-part application of U.S. patent application Ser. No. 14/478,342, entitled Extended Reach Methods for Multistage Fracturing Systems filed on Sep. 5, 2014, which is incorporated by reference herein in its entirety.

FIELD OF THE DISCLOSURE

The embodiments described herein related to a method and system for monitoring and/or optimizing a bottom hole assembly during a coiled tubing operation. The monitoring of the bottom hole assembly may permit the optimization of the insertion rate of the coiled tubing, the optimization of a vibratory tool, the optimization of the operation of a wellbore tractor, and/or the optimization of the injection of lubricant into the wellbore.

BACKGROUND

Description of the Related Art

With more long laterals currently being drilled in wells throughout the world, multistage technologies are becoming more popular. In addition, the length of lateral or horizontal wellbore is increasing with plans for laterals to reach as far as 10,000 feet. Increasing the length of a horizontal wellbore may result in difficulty in reaching the end of the horizontal wellbore with tools conventional conveyed on coiled tubing. At a point along the length of the horizontal wellbore, the coefficient of friction between the coiled tubing and the casing of the horizontal wellbore increases to the point that the friction between the two prevents the further insertion of the tool on the coiled tubing string. Lubricants have been used to reduce the coefficient of friction in the wellbore between components. However, most commercially available lubricants exhibit limited capability of extending the reach along a lateral or horizontal wellbore at approximately 6,000 feet. Additionally, lubricant injection into a horizontal wellbore is often dissipated by subsequent treatment procedures conducted within the wellbore. It would be beneficial to provide a system and method of permitting farther reach capabilities into a horizontal wellbore with a coiled tubing string.

As a bottom hole assembly is conveyed on coiled tubing into a horizontal wellbore, the bottom hole assembly may include a device that is configured to aid in the movement of the bottom hole assembly along the horizontal wellbore. For example, the bottom hole assembly may include a vibratory tool, such as a fluid hammer, that is configured to reduce the friction with the wellbore or the bottom hole assembly and may include a tractor designed to push or pull the bottom hole assembly along the horizontal wellbore. However, the rate of insertion of the coiled tubing may not be optimal. For example, the insertion rate may be too slow to fully take advantage of the friction reducing device or the force provided from a tractor. Alternatively, an insertion rate that is too high may cause the coiled tubing to bind uphole causing the friction reducing device or tractor to have a higher load because the insertion rate is not being seen at the bottom hole assembly. Lubricant may also be injected into the wellbore to decrease the friction between the coiled tubing, bottom hole assembly, and the wellbore. However, more or less than an optimal amount of lubricant to reduce the friction may be injected into the wellbore.

SUMMARY

The present disclosure is directed to an extended reach method within a horizontal wellbore that overcomes some of the problems and disadvantages discussed above.

One embodiment is a method of treating a horizontal wellbore comprising positioning a bottom hole assembly within a horizontal wellbore adjacent a first production zone of the horizontal wellbore. The bottom hole assembly is connected to a coiled tubing string. The method comprises creating a flow path between the first production zone and an annulus between the coiled tubing string and a casing string of the horizontal wellbore and pumping a first pad fluid down the annulus to the first production zone. The method comprises pumping a treatment fluid down the annulus to the first production zone and pumping a first flushing fluid down the annulus beyond the first production zone. The method comprises reducing a coefficient of friction between the casing string and the coiled tubing string by pumping lubricant within the first flushing fluid.

Reducing the coefficient of friction may further comprise pumping fluid down an interior of the coiled tubing string to actuate a vibratory device connected to the coiled tubing string. The first treatment fluid may include sand and/or proppant. Pumping the first treatment fluid may fracture the first production zone. Pumping the first flushing fluid may move proppant and/or sand into the fractures of the first production zone and may substantially remove the proppant and/or sand from the horizontal wellbore adjacent the first production zone. The method may include modeling the reduction of the coefficient of friction between the casing string and the coiled tubing string between the first production zone and a second production zone. The amount of lubricant pumped within the first flushing fluid may be based on the modeling. The amount of lubricant pumped within the first flushing fluid may be a predict amount to cover the casing between the first production zone and the second production zone.

Based on the modeling, the method may include pumping fluid down the coiled tubing string to actuate a vibratory device connected to the coiled tubing string. The method may include positioning the bottom hole assembly adjacent the second production zone of the horizontal wellbore. Creating a flow path between the first production zone and the annulus may comprise moving a first sleeve to open a first port in the casing string. The method may comprise creating a flow path between the second production zone and the annulus. The method may include pumping a second pad fluid down the annulus to the second production zone and pumping a second treatment fluid down the annulus to the second production zone. The second pad fluid may be substantially comprised of the first flushing fluid. The method may comprise pumping a second flushing fluid down the annulus to beyond the second production zone and reducing the coefficient of friction between the casing string and the coiled tubing string by pumping lubricant within the second flushing fluid.

One embodiment is a system to treat a multizone horizontal wellbore. The system comprises a casing string and a coiled tubing string positioned within the casing string. The system comprises a vibratory tool connected to the coiled tubing string, the vibratory tool being actuated to vibrate upon fluid being pumped through the coiled tubing string. The vibration of the vibratory tool reduces a coefficient of friction between the coiled tubing string and the casing string. The system comprises a bottom hole assembly connected to the coiled tubing string below the vibratory tool, the bottom hole assembly configured to permit an individual treatment of multiple production zones of the horizontal wellbore via an annulus between the coiled tubing string and the casing string.

The vibratory tool may comprise a fluid hammer tool that is actuated to vibrate by fluid pumped through the coiled tubing string. The bottom hole assembly may include at least one packing element that may be actuated to create a seal within the annulus. The casing string may include at least one port and at least one sleeve for each production zone, wherein each sleeve may be moved to permit communication between the production zone and the annulus.

One embodiment is a method of treating a horizontal wellbore comprising positioning a bottom hole assembly within a casing string of a horizontal wellbore adjacent a first production zone of the horizontal wellbore. The bottom hole assembly is connected to a coiled tubing string. The method comprises treating the first production zone and reducing a coefficient of friction between the casing string and the coiled tubing string. The method comprises moving the bottom hole assembly adjacent a second production zone of the horizontal wellbore.

Treating the first production zone may comprise pumping fluid down an annulus between the coiled tubing string and the casing string to fracture the first production zone. Reducing the coefficient of friction may comprise actuating a vibratory tool. The vibratory tool may be a fluid hammer tool. Reducing the coefficient of friction may comprise pumping flushing fluid down the annulus between the coiled tubing string and the casing string, the flushing fluid including a lubricant. The method may comprise treating the second production zone and reducing the coefficient of friction between the casing string and the coiled tubing string after treating the second production zone.

One embodiment is a method of monitoring a coiled tubing operation comprising positioning a bottom hole assembly (BHA) within a horizontal wellbore, the BHA being connected to a coiled tubing string. The method comprises monitoring a plurality of sensors connected to the BHA via a communication line positioned within the coiled tubing string and determining an optimal injection speed of the coiled tubing string by monitoring the plurality of sensors in real-time.

The method may comprise changing the injection speed of the coiled tubing string in real-time based on the real-time determination of the optimal injection speed. A vibratory tool may be connected to the BHA. The method may comprise powering the vibratory tool via the communication line. The plurality of sensors may be connected to the vibratory tool. A tractor may be connected to the BHA. The method may comprise powering the tractor via the communication line. The plurality of sensors may be connected to the tractor. The method may comprise determining in real-time an optimal amount of lubricant within the wellbore to permit the advancement of the BHA along the horizontal wellbore by monitoring the plurality of sensors in real-time. The method may comprise injecting in real-time the optimal amount of lubricant into the wellbore. The method may comprise powering the sensors via the communication line. The plurality of sensors may comprise a first tension sensor, a second compression sensor, and a third torque sensor. The method may comprise determining in real-time whether the coiled tubing string is forming a helix within the wellbore by monitoring the plurality of sensors in real-time.

One embodiment is a system to perform a coiled tubing string operation comprising a coiled tubing string and a communication line positioned within the coiled tubing string. The system comprises a BHA connected to the coiled tubing string and a plurality of sensors connected to the communication line.

The plurality of sensors may be connected to the BHA. The plurality of sensors may be powered via the communication line. The plurality of sensors may comprise a first tension sensor, a second compression sensor, and a third torque sensor. The system may comprise a vibratory tool connected to the BHA. The communication line may power the vibratory tool. The system may comprise a tractor connected to the BHA. The communication line may power the tractor.

Figure 1:
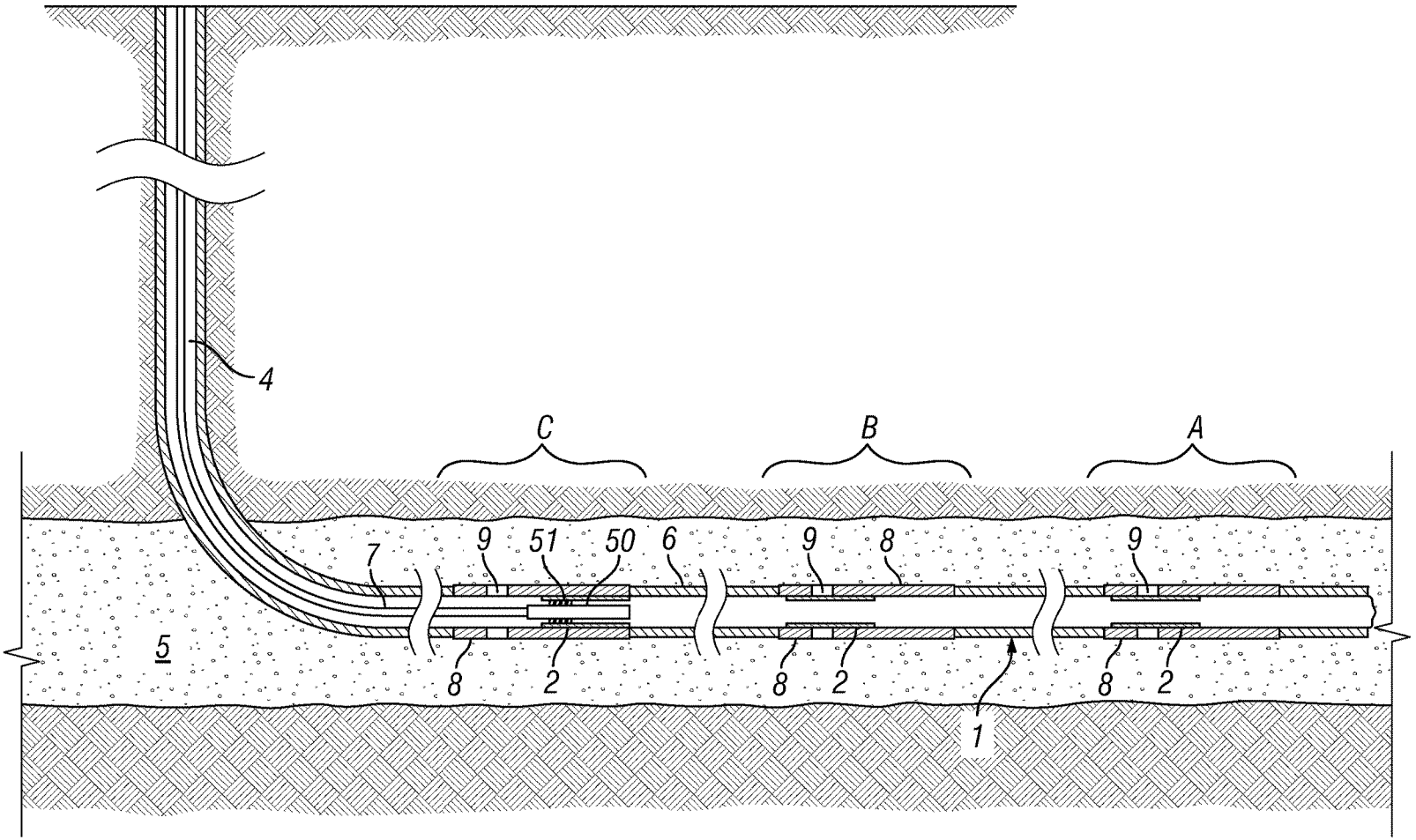
FIG. 1 shows a coiled tubing string positioned within a portion of a horizontal wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a coiled tubing string 7 positioned within a portion of a horizontal wellbore 1 that traverses a formation 5. As used herein, horizontal wellbore include any highly deviated wellbore that may require decreasing the coefficient of friction for a coiled tubing string to reach the end of the wellbore. A bottom hole assembly (BHA) 50 may be attached at or near the end of the coiled tubing string 7. The coiled tubing string 7 may be used to convey the BHA 50 into the horizontal well so that different portions of the formation 5 may be treated and/or serviced in various ways by the BHA 50 as would be appreciated by one of ordinary skill in the art having the benefit of this disclosure. The formation 5 may be treated at production zones through ports in the casing 6, which may be selectively opened and closed with sleeves 2 connected to the casing 6. For example, port collars that may be selectively opened as disclosed in U.S. Pat. No. 8,695,716 entitled Multi-Zone Fracturing Completion, which is incorporated by reference herein in its entirety, may be positioned along the length of casing at the production zones in the formation 5. Alternatively, the BHA 50 may include various mechanisms to open a flow path to the formation 5 to permit treatment of the formation 5 through the casing 6, such as a sand jet perforator.

As the lengths of horizontal laterals and horizontal wellbores continue to increase, it may become more difficult to position a coiled tubing conveyed tool to the end of the wellbore. As the coiled tubing string 7 travels along the horizontal wellbore 1 it may reach a point at which the friction between the casing 6 and the coiled tubing 7 and/or the BHA 50 prevents continued movement of the coiled tubing string 7 down the horizontal wellbore 1. As shown in FIG. 1, the coiled tubing string 7 has positioned the BHA adjacent production zone C, but the friction between the coiled tubing string 7 and the casing 6 may prevent the movement to productions zones A and B located beyond zone C. The system and method disclosed herein permit the decrease in the coefficient of friction permitting the coiled tubing string 7 to reach farther into the horizontal wellbore 1. The location and number of the production zones A, B, and C is for illustrative purposes only and may be varied within a horizontal wellbore 1 as would be appreciated by one of ordinary skill in the art. Further, the identification of production zone C as being the location at which the friction between the coiled tubing string 7 and the casing 6 prevents further travel along the horizontal wellbore 1 without taking additional steps to reduce the coefficient of friction is for illustrative purposes only.

FIG. 1 shows ported collars 8 positioned along the casing 6 with the ported collars 8 being positioned within the shown production zones A, B, and C. A sleeve 2 may be actuated between a closed position that prevents fluid communication through port(s) 9 in a ported collar 8 and an open position that permits fluid communication from the annulus 4 between the coiled tubing string 7 and casing 6 with the formation 5 through the port(s) 9. The sleeves 2 may be actuated between the open and closed positions by various mechanisms. For example, the sleeves 2 may be actuated by the application of a pressure differential or may be shifted by a shifting tool. Various other mechanisms may be used to selectively provide a flow path between the annulus 4 and the formation 5 through the casing 6 as would be appreciated by one of ordinary skill in the art having the benefit of this disclosure. For example, a sand jetting tool could be used to create a flow path or the casing may include weak points adapted to burst upon the application of predetermined amount of pressure. A packing element(s) 51 on the BHA 50 may be used to isolate a portion of the horizontal wellbore 1 during treatment of a production zone A, B, or C. Treating a production zone A, B, or C may comprises various treatments such as fracturing the zone or a matrix acid treatment.

Figure 2:
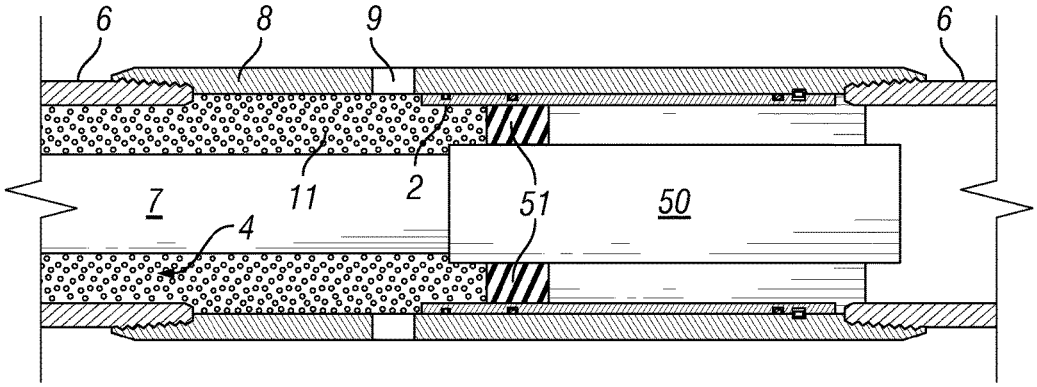
FIG. 2 shows pumping a fluid pad down an annulus between a coiled tubing string and a casing.

FIG. 2 shows a close up view of the BHA 50 positioned within the casing 6 at a production zone to be treated. A fluid flow path may be created between the annulus 4 between the coiled tubing string 7 and the casing 6 by various means. For example, the casing string may include ported collars 8 connected along the casing 6 at the various production zones. FIG. 2 shows the sleeve 2 of the ported collar 8 moved to the open position to expose port 9, which permits fluid communication from the annulus 4 to the formation 5 (shown in FIG. 1). The packing element 51 of the BHA 50 may be actuated to engage the collar 8, or casing 6, to isolate the annulus 4 below the BHA 50. Pad fluid 11 may be pumped down the annulus 4 in a first step to treat the formation through the port 9.

Figure 3:
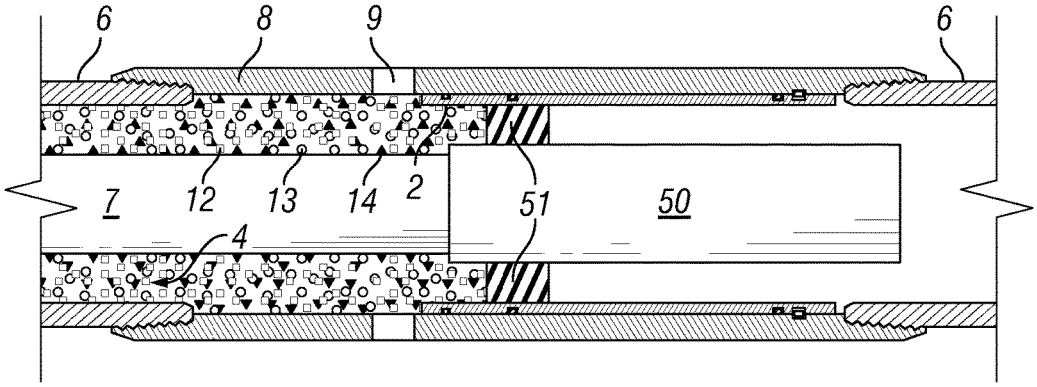
FIG. 3 shows pumping a treatment fluid down an annulus between a coiled tubing string and a casing.

After the pad fluid 11 has been pumped down the annulus 4, a treatment fluid 12 may be pumped down the annulus 4 to treat the formation through the flow path to the formation 5, which happens to be port 9 shown in FIG. 3. The treatment fluid 12 may be various treatment fluids such as an acid matrix or fracturing fluid. The treatment fluid 12 may contain proppant 13 and/or sand 14 as shown in FIG. 3.

Figure 4:
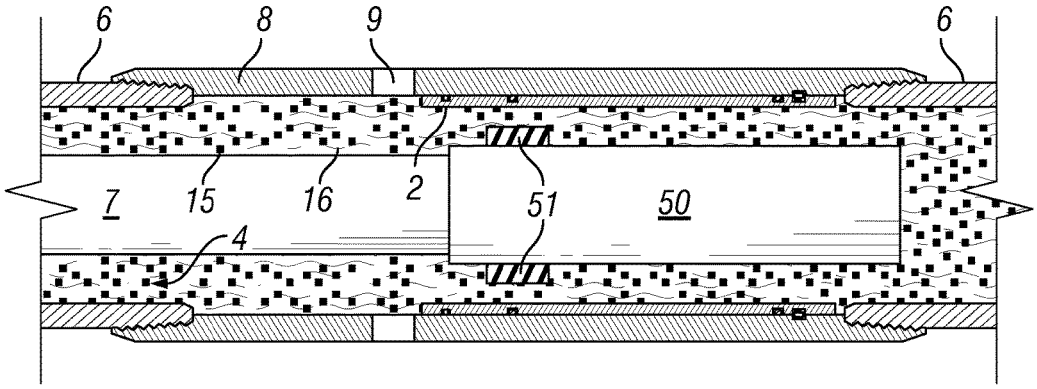
FIG. 4 shows pumping a flush fluid with a lubricant down an annulus between a coiled tubing string and a casing.
Figure 5:
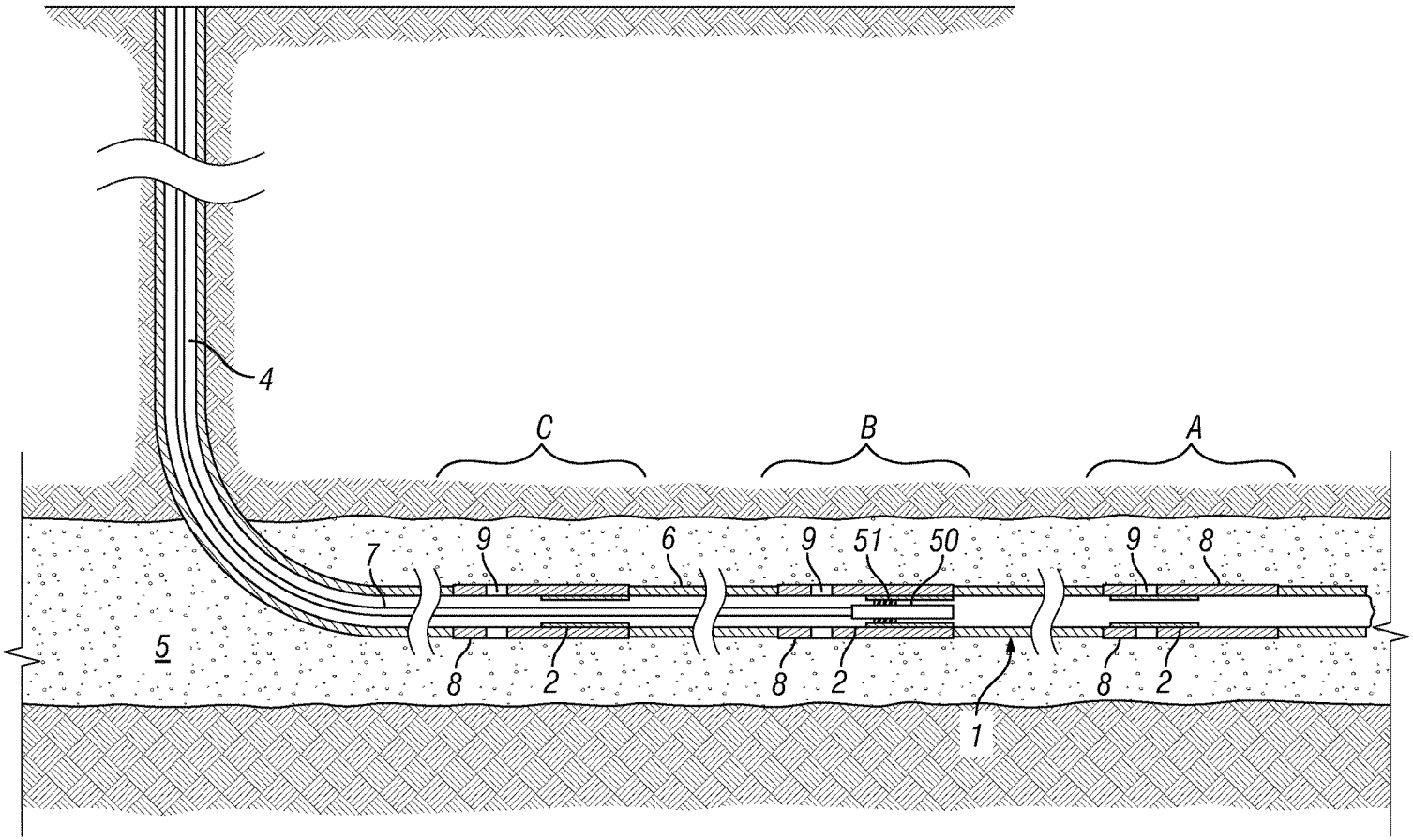
FIG. 5 shows a coiled tubing string with a bottom hole assembly positioned within a portion of a horizontal wellbore.

As shown in FIG. 4, a flush fluid 15 may be pumped down the annulus 4 after the treatment fluid 12. The flush fluid 15 may be used to push the proppant 13 and/or sand 14 into the formation and/or clean the proppant 13 and/or sand 14 out of the wellbore. A lubricant 16 may be included within the flush fluid 15 that reduces the coefficient of friction between the casing 6 and the coiled tubing string 7 and the BHA 50. The packing element 51 of the BHA 51 may be unset to permit the flush fluid 15 and lubricant 16 to travel down the horizontal wellbore 1 past the BHA 50. The lubricant 16 may comprise various lubricants disclosed in U.S. patent application Ser. No. 14/212,050 entitled Lubricating Compositions for Use with Downhole Fluids filed on Mar. 14, 2014 that claims the benefit of U.S. Provisional Patent Application No. 61/842,680 filed Jul. 3, 2013, both of which are incorporated by reference herein in their entirety. The use of a lubricant 16 in the flush fluid 15 may permit the BHA 50 to move to the next production zone B as shown in FIG. 5.

Once the BHA 50 is located at the next production zone, a flow path to the formation may be created, a pad fluid 11 may be pumped down the annulus 4, a treatment fluid 12 may then be pumped down the annulus 4, and a flush fluid 15 with lubricant 16 may then be pumped down the annulus 4. In some instances, the pad fluid 11 of a zone may comprise the flush fluid 15 pumped down the annulus of a previously treated production zone. The repeated pumping of lubricant 16 within flushing fluid 15 at individual production zones may ensure that adequate lubricant 16 is retained within the casing 6 to lower the coefficient of friction and permit the movement of the BHA 50 as opposed to pumping lubricant 16 into the casing 6 prior to treating multiple production zones. As discussed above, the repeated pumping of fluids down the annulus 4 may move the lubricant 16 out of the casing 1 and into the formation 5 if a lubricant 16 is pumped into the casing 6 prior to the treatment operations.

Figure 6:
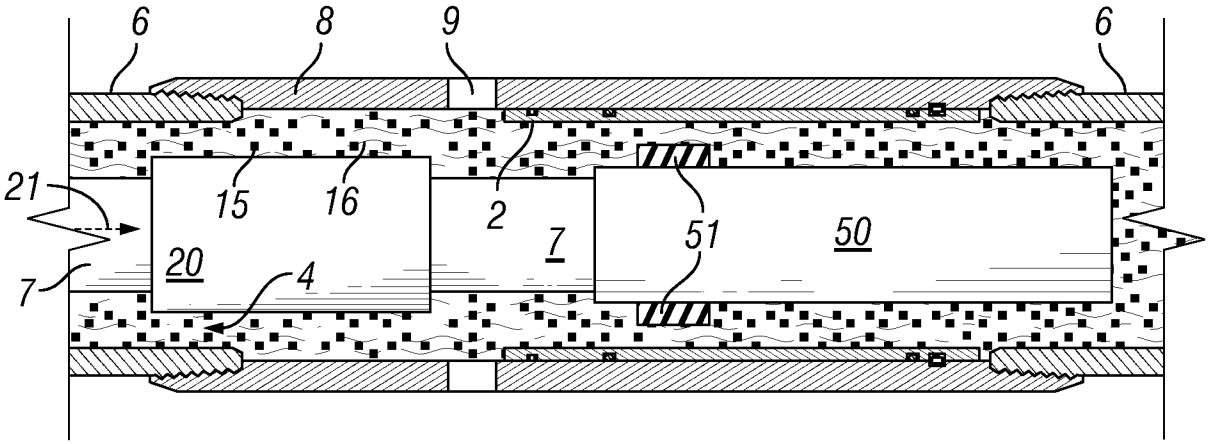
FIG. 6 shows an embodiment of a vibratory tool connected to a tubing string to reduce the coefficient of friction between the casing and the coiled tubing.

FIG. 6 shows a vibratory tool 20 connected to the coiled tubing string 7 that may be used to reduce the coefficient of friction between the casing 6 and the coiled tubing 7 and/or the BHA 50. The vibratory tool 20 may be actuated by various mechanisms to vibrate within the casing 6 and decrease the coefficient of friction. For example, fluid may be pumped down the coiled tubing string 7, as indicated by arrow 21, to actuate the vibratory tool 20. The vibration of the vibratory tool 20 may decrease the coefficient of friction permitting the BHA 50 and coiled tubing 7 to travel farther along the casing 6 of a horizontal wellbore 1. The vibratory tool 20 may be a fluid hammer tool that operates based on the Coandă effect with the flow of fluid down the coiled tubing 7 causing the tool 20 to vibrate. For example, the vibratory tool 20 may be the tool disclosed in U.S. Pat. No. 8,272,404 entitled Fluidic Impulse Generator, which is incorporated by reference herein in its entirety. The vibratory tool 20 may be used alone to reduce the coefficient of friction between the coiled tubing 7 and the casing 6 or may be used in combination flush fluid 15 having lubricant 16 within the annulus 4 to reduce the coefficient of friction between the coiled tubing 7 and the casing 6.

Figure 7:
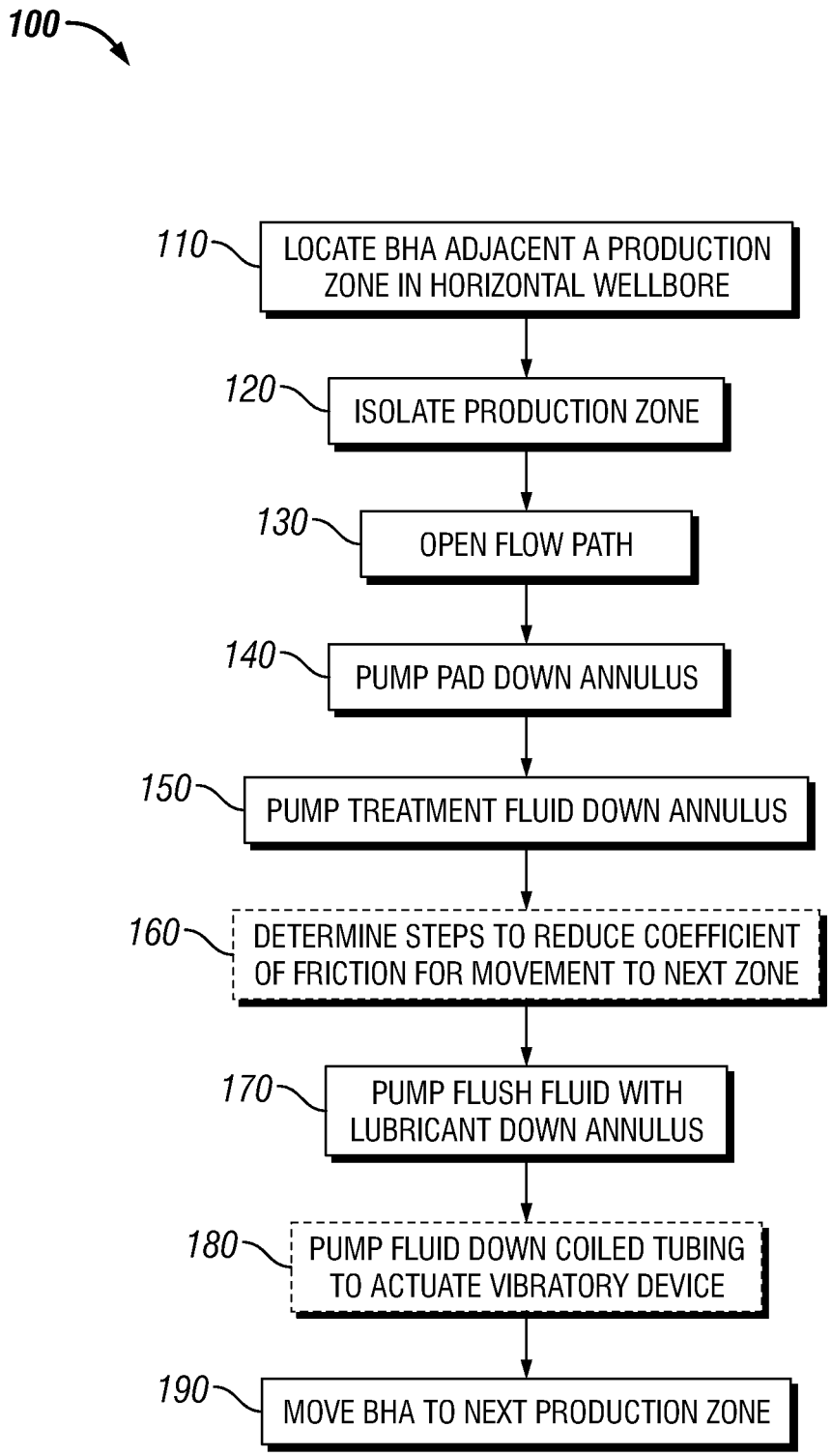
FIG. 7 shows method of treating a portion of a horizontal wellbore.

FIG. 7 shows a flow chart of a method 100 for treating a horizontal wellbore. The method 100 includes the step 110 of locating a BHA adjacent a production zone in the horizontal wellbore and includes the step 120 of isolating the production zone. The BHA will be conveyed into the horizontal wellbore on a coiled tubing string. Various mechanisms may be used to isolate the production zone such as actuating at least one packing element of a BHA. The method 100 includes the step 130 of opening a flow path between the casing and the formation. The opening of a flow path may comprise moving a sleeve to expose a port, but various other mechanisms of creating a flow path are available as would be appreciated by one of ordinary skill in the art having the benefit of this disclosure. In step 140, a fluid pad is pumped down the annulus to the isolated production zone and then a treatment fluid is pumped down the annulus to the production zone in step 150. The treatment fluid may be various fluids such as a matrix acid application or fracturing fluid.

The method may include the optional step 160 of determining what steps may be necessary to reduce the coefficient of friction between the coiled tubing and the casing so that the BHA may be moved beyond the present production zone. Step 160 may be done using modeling software such as CIRCA, or the like, to determine the optimal steps required to reduce the coefficient of friction for various portions of a horizontal wellbore. The modeling software may be used to determine the requisite steps to reduce the coefficient of friction prior to the BHA entering the horizontal wellbore. Alternatively, the determining step 160 may be done as each new zone is reached with the BHA along progression along the length of a horizontal wellbore. The determining step 160 may indicate the amount, concentration, and/or type of lubricant needed to be added to the flush fluid to adequately reduce the coefficient of friction of a designated length of the horizontal wellbore. Step 160 may determine that lubricant should be pumped down the annulus with flush fluid to decrease the coefficient of friction in step 170. Step 160 may also determine that a vibratory device should be actuated to decrease the coefficient of friction. If so, fluid may be pumped down the coiled tubing to actuate the vibratory device in optional step 180. In step 190, the BHA is moved to the next production zone. The BHA may be moved while the vibratory tool is vibrating in optional step 180.

Figure 8:
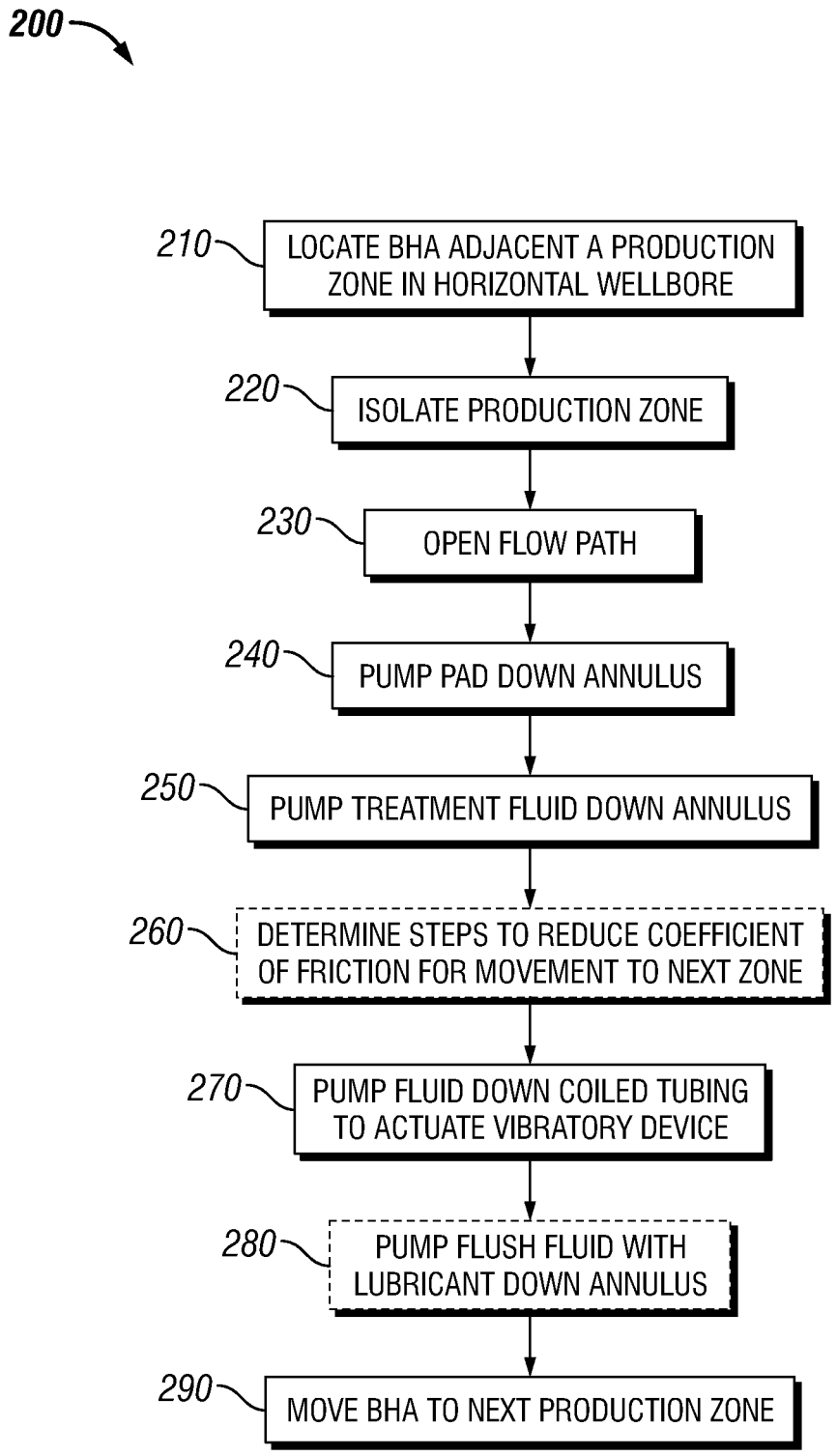
FIG. 8 shows method of treating a portion of a horizontal wellbore.

FIG. 8 shows a flow chart of a method 200 for treating a horizontal wellbore. The method 200 includes the step 210 of locating a BHA adjacent a production zone in the horizontal wellbore and includes the step 220 of isolating the production zone. The BHA will be conveyed into the horizontal wellbore on a coiled tubing string. Various mechanisms may be used to isolate the production zone such as actuating at least one packing element of a BHA. The method 200 includes the step 230 of opening a flow path between the casing and the formation. The opening of a flow path may comprise moving a sleeve to expose a port, but various other mechanisms of creating a flow path are available as would be appreciated by one of ordinary skill in the art having the benefit of this disclosure. In step 240, a fluid pad is pumped down the annulus to the isolated production zone and then a treatment fluid is pumped down the annulus to the production zone in step 250.

The method may include the optional step 260 of determining what steps may be necessary to reduce the coefficient of friction between the coiled tubing and the casing so that the BHA may be moved beyond the present production zone. Step 260 may determine that a vibratory device should be actuated to decrease the coefficient of friction. If so, fluid may be pumped down the coiled tubing to actuate the vibratory device in step 270. Step 260 may determine that lubricant should also be pumped down the annulus with the flush fluid to decrease the coefficient of friction in step 280. In step 290, the BHA is moved to the next production zone. The BHA may be moved while the vibratory tool is vibrating in step 270.

Figure 9:
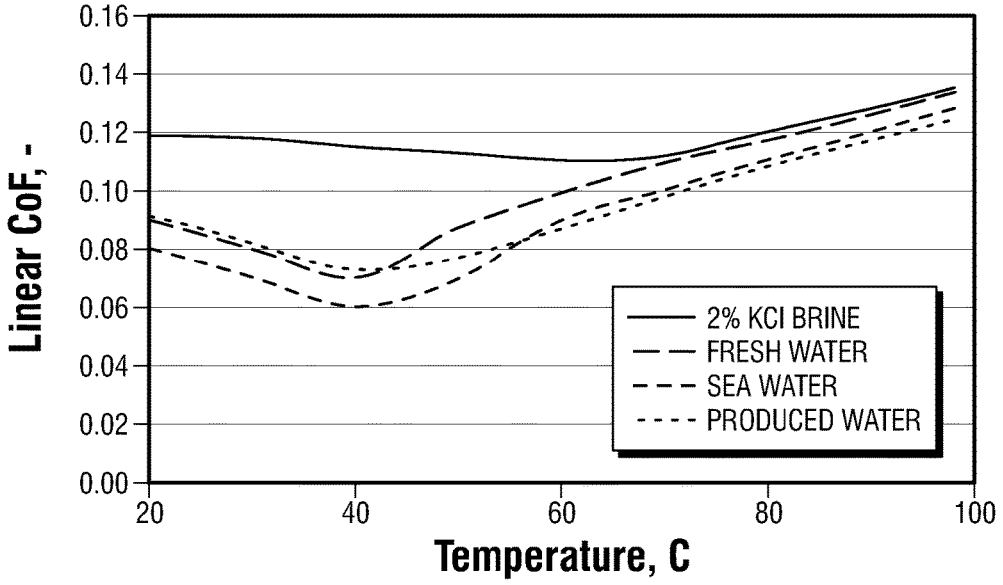
FIG. 9 shows the temperature dependence in reducing the coefficient of friction of a lubricant mixed with a base fluid.
Figure 10:
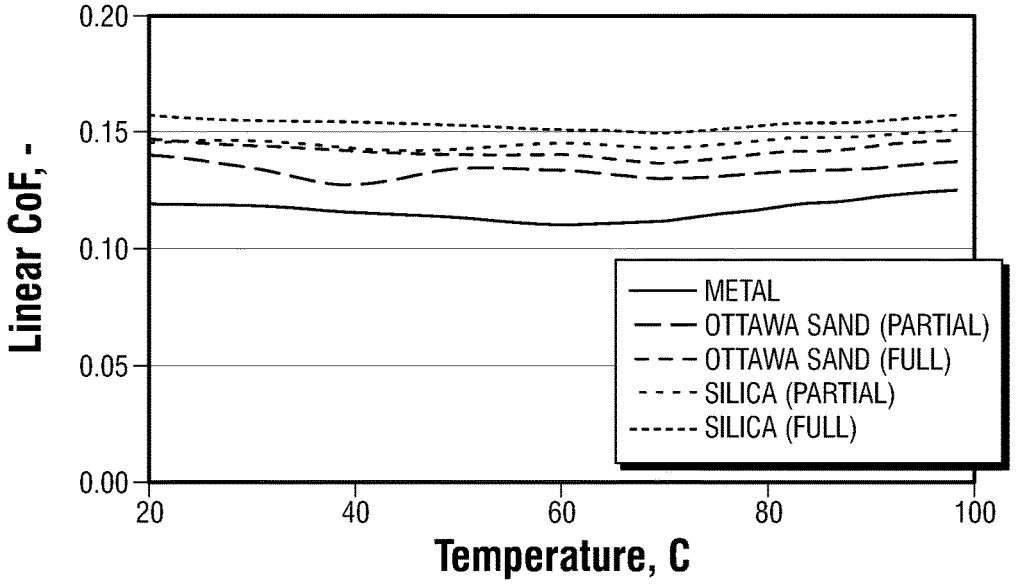
FIG. 10 shows the temperature dependence in reducing the coefficient of friction of a lubricant mixed with a base fluid on a surface with Ottawa sand or silica.
Figure 11:
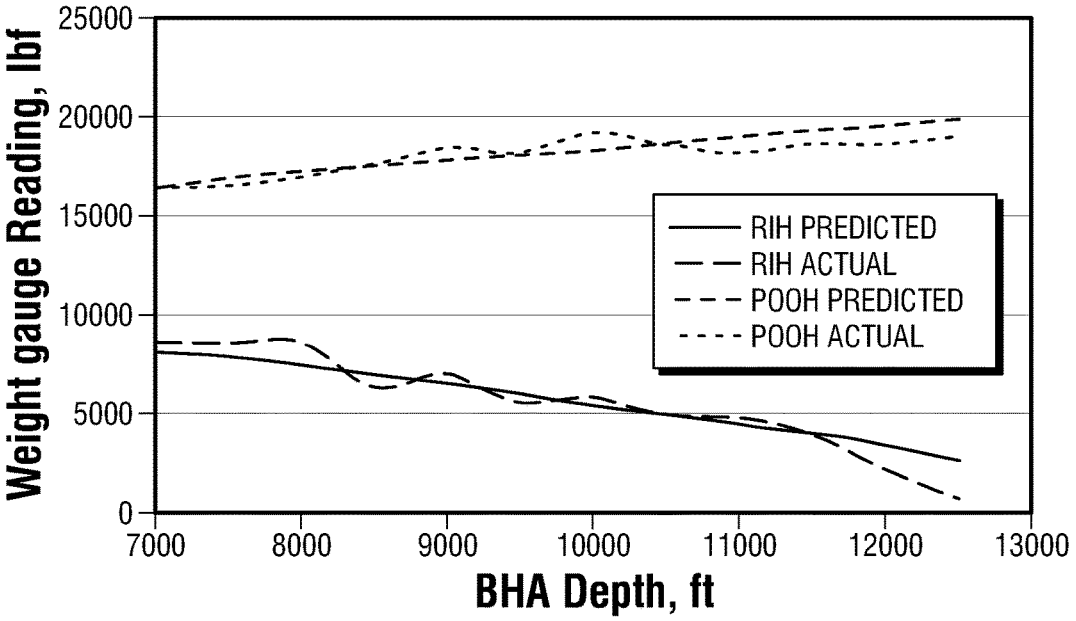
FIG. 11 shows modeled and actual weight gauge curves.

FIGS. 9-11 represent information that may be determined and/or used in modeling of a horizontal wellbore to determine the potential operations that may enable a coiled tubing string travel farther along a horizontal wellbore. FIG. 9 illustrates the potential a particular lubricant, EasyReach™ lubricant offered commercially by Baker Hughes of Houston, Tex., may have on reducing the coefficient of friction. FIG. 9 shows the reduction of the coefficient of friction over a various temperature range when 1% of EasyReach™ lubricant is mixed in four base fluids with 0.1% fluid fiction reducer with the four base fluids being, 2% KCl brine, fresh water, sea water, and produced water. FIG. 10 illustrates the temperature dependence of the coefficient of friction for a solution of 1% EasyReach™ lubricant in a 2% KCl brine and 0.1% fluid friction reduce on surfaces with Ottawa sand and silica. FIG. 11 shows predicted and actual weight gauge curves for running in hole (RIH) and pulling out of hole (POOH) using a lubricant mixed in 2% KCl brine and 0.1% fluid friction reducer. A fluid hammer tool, the EasyReach™ extended reach tool offered commercially by Baker Hughes of Houston, Tex., was used in the field trial to determine the actual weight gauge curves.

Figure 12:
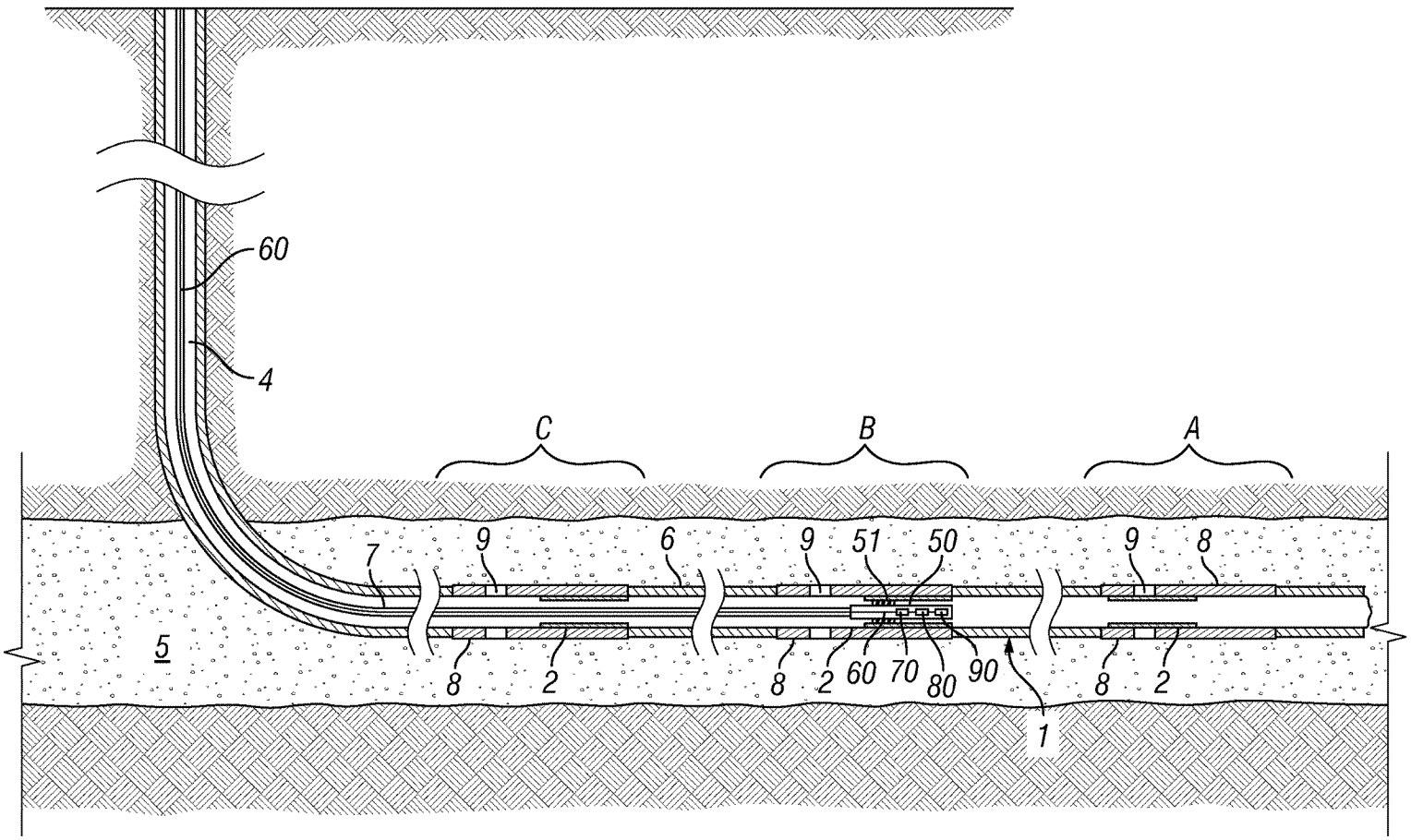
FIG. 12 shows an embodiment of a bottom hole assembly in communication with the surface via a communication line.

FIG. 12 shows a BHA 50 positioned within a horizontal wellbore 1 connected to the surface with a communication line 60 positioned within coiled tubing 7 used to convey the BHA 50 into the wellbore 1. The communication line 60 is connected to three sensors 70, 80, and 90 positioned on the BHA 50. The communication line 60 may be configured to not only communicate signals between the sensors 70, 80, and 90 and the surface, but also may be used to provide power to the sensors 70, 80, and 90 as well as potentially to provide power to various elements of the BHA 50. The communication line 60 may be TeleCoil™ commercially offered by Baker Hughes of Houston, Tex. Alternatively, the communication line 60 may be comprised of fiber optics. The horizontal wellbore 1 is shown as a multizone horizontal wellbore for illustrative purposes only. The embodiment of a BHA 50 in communication with the surface via a communication line 60 may be used in any horizontal and/or deviated wellbore as would be appreciated by one of ordinary skill in the art having the benefit of this disclosure.

The sensors 70, 80, and 90 may be used to monitor a coiled tubing operation and potentially the information from the sensors 70, 80, and 90 may be used in real-time to optimize the coiled tubing operation. The first sensor 70 may be a tension sensor, the second sensor 80 may be a compression sensor, and the third sensor 90 may be a torque sensor. The configuration and location of the sensors 70, 80, and 90 is for illustrative purposes only and may be varied as would be appreciated by one of ordinary skill in the art having the benefit of this disclosure. For example, the sensors 70, 80, and 90 could be positioned on a fluid hammer 20 (shown in FIG. 13) or on a tractor 30 (shown in FIG. 14) connected to the BHA 50.

The sensors 70, 80, and 90 may be used to monitor in real-time the tension, compression, and torque measured at the BHA 50. As discussed herein, lubricant may be injected into the wellbore to aid the movement of the BHA 50 along the wellbore 1. Real-time information may be provided to the operator at the surface via the communication line 60 to better determine the optimal injection of lubricant into the wellbore 1.

Figure 13:
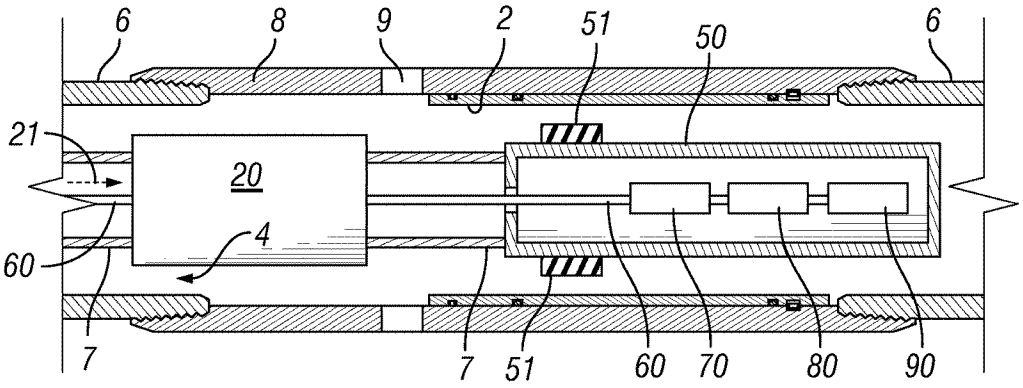
FIG. 13 shows an embodiment of a bottom hole assembly connected to a vibratory tool that may be monitored at the surface via a communication line.

FIG. 13 shows a BHA 50 and a vibratory tool 20 connected to a coiled tubing string 7 positioned within a collar 8 of a casing string 6 of a wellbore. Sensors 70, 80, and 90 on the BHA 50 are connected to the surface via a communication line 60 as discussed herein. The sensors 70, 80, and 90 may be used to optimize the insertion of the BHA 50 into the wellbore. The vibratory tool 20 may be hydraulically actuated to vibrate as discussed herein to reduce the friction between the casing 6 and the BHA 50. The sensors 70, 80, and 90 may be used to monitor tension, compression, and torque to determine whether the coiled tubing 7 is being inserted into the wellbore at the optimal rate. For example, the injection rate of the coiled tubing 7 may be too slow to take full advantage of the reduced friction awarded from the vibratory tool 20. On the other hand, the injection rate of the coiled tubing 7 may be too high causing the coiled tubing 7 to bind up within the casing 6 uphole of the BHA 50. The communication line 60, which may be TeleCoil™, may be used to power the sensors 70, 80, and 90. Alternatively, the sensors 70, 80, and 90 may be powered via a battery. In one embodiment, the vibratory tool 20 is an electrical vibratory tool that is powered via the communication line 60. In one embodiment the vibratory tool 20 may be powered via a battery.

Figure 14:
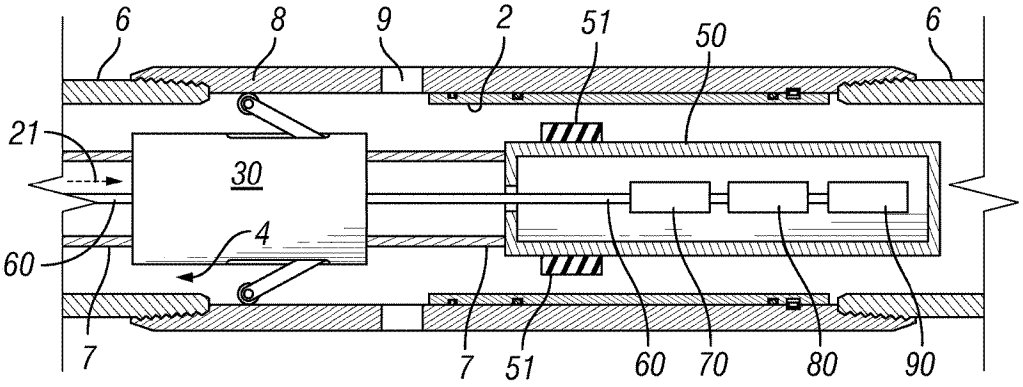
FIG. 14 shows an embodiment of a bottom hole assembly connected to a tractor that may be monitored at the surface via a communication line.

FIG. 14 shows a BHA 50 and a tractor 30 connected to a coiled tubing string 7 positioned within a collar 8 of a casing string 6 of a wellbore. Sensors 70, 80, and 90 on the BHA 50 are connected to the surface via a communication line 60 as discussed herein. The sensors 70, 80, and 90 may be used to optimize the insertion of the BHA 50 into the wellbore. The tractor 30 may be hydraulically actuated to move the BHA 50 along the casing 6. The tractor 30 may push or pull the BHA 50 along the casing 6. The sensors 70, 80, and 90 may be used to monitor tension, compression, and torque to determine whether the coiled tubing 7 is being inserted into the wellbore at the optimal rate. For example, the injection rate of the coiled tubing 7 may be too slow to take full advantage of the force provided by the tractor 20 and in fact, may be hindering the movement of the BHA 50 and the tractor 30. On the other hand, the injection rate of the coiled tubing 7 may be too high causing the coiled tubing 7 to bind up within the casing 6 uphole of the BHA 50. With the coiled tubing 7 bound up within the casing 6, the tractor 30 may not be aided by the injection of the coiled tubing 7, but rather may now need to pull the portion of coiled tubing 7 past the pinch point along the wellbore. The communication line 60, which may be TeleCoil™, may be used to power the sensors 70, 80, and 90. Alternatively, the sensors 70, 80, and 90 may be powered via a battery. In one embodiment, the tractor 30 is an electrically operated being powered via the communication line 60. In one embodiment, the tractor 30 may be powered by a battery.

As a BHA is run into a horizontal wellbore various steps may be taken to reduce the friction between the BHA and the wellbore as discussed herein to permit the BHA to travel farther along the wellbore. For example, lubricant may be injected into the wellbore and/or a vibratory tool may be used to reduce the friction between the BHA and the wellbore. A tractor may be connected to the coiled tubing string that may be used to move the BHA along the horizontal wellbore. It may be difficult to determine whether the optimal amount of lubricant is being injected into the wellbore. It also may be difficult to determine whether the insertion rate of the coiled tubing being inserted into the wellbore is aiding or hindering the operations of a vibratory device or a tractor connected to the coiled tubing string. For example, the injection rate of the coiled tubing may be too slow hindering the movement of the BHA by a tractor and/or a vibratory tool. Alternatively, the injection rate of the coiled tubing may be too fast causing the coiled tubing to coil within the wellbore. Sensors may be used to gain information about the downhole operation to optimize the injection rate of the coiled tubing and/or to optimize the injection of lubricant into the wellbore.

Figure 15:
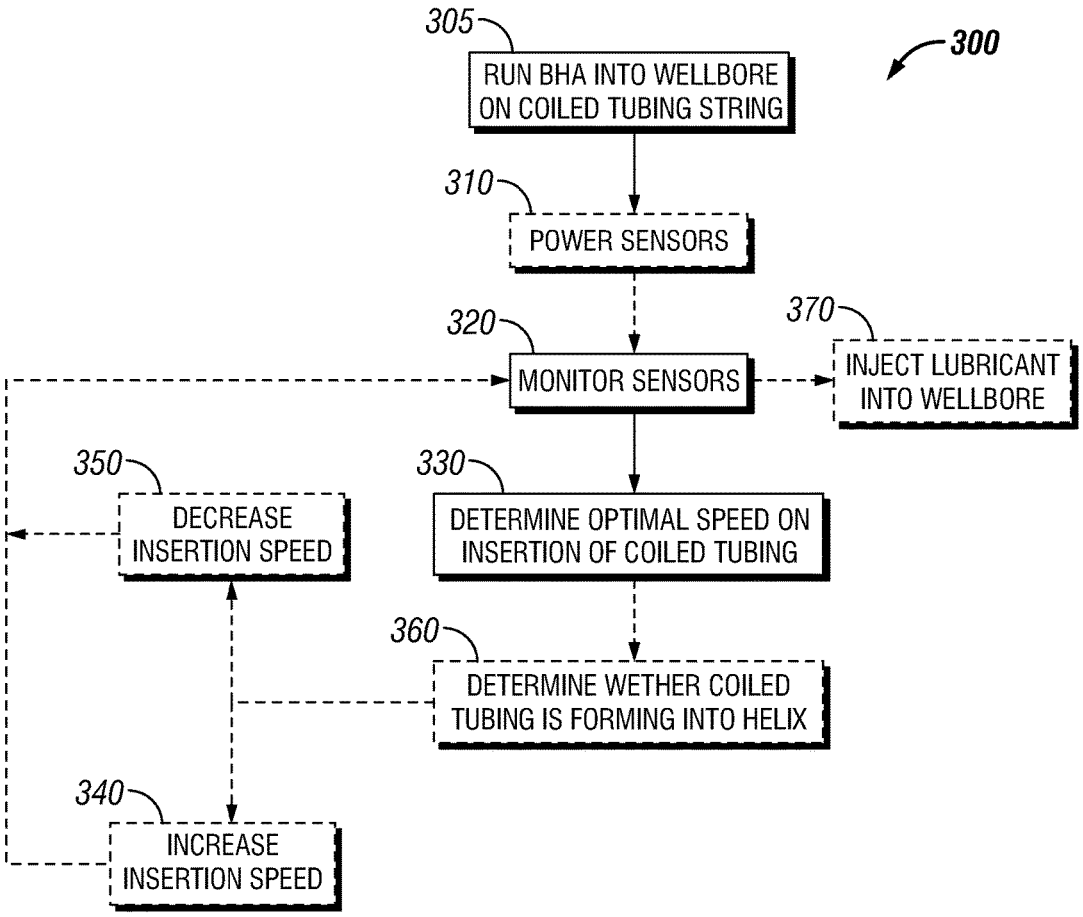
FIG. 15 shows an embodiment of a method of monitoring and/or optimizing a coiled tubing operation.

FIG. 15 shows one embodiment of a method 300 of monitoring and/or optimizing a coiled tubing operation. In step 305, a BHA is run into a wellbore on a coiled tubing string. Downhole information may be obtained in real-time at the surface in step 320 of monitoring downhole sensors connected to the surface via a communication line. The sensors may be located on a portion of the BHA and/or on a tool connected to the BHA such as a tractor or a vibratory tool as would be appreciated by one of ordinary skill in the art having the benefit of this disclosure. Optionally, the sensor may be powered in step 310 via the communication line. For example, the communication line may be TeleCoil™ offered commercially by Baker Hughes of Houston, Tex. that permits the transmission of both power and communication signals. Based on the real-time monitoring of the downhole sensors, in step 370 lubricant may be optionally injected into the wellbore and/or the injection rate may be varied in real-time based on information provided by the sensors.

In step 330 of the method, the optimal insertion speed of the coiled tubing is determined. The optimal insertion speed is determined in real-time based on information provided from the sensors via the communication line. The insertion speed may optionally be decreased in step 350 based on the real-time data from the sensors. Likewise, the insertion speed may optionally be increased in step 340 based on the real-time data from the sensors. In optional step 360, a determination whether the coiled tubing is forming into a helix within the wellbore may be made based on the real-time data from the sensors. The insertion speed of the coiled tubing may be altered based on the determination made in step 360. After there is a change in the insertion speed in either step 340 or step 350, the process may be repeated by the continual monitoring of sensors in real-time in step 320.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A method of monitoring a coiled tubing operation comprising:

injecting a coiled tubing string into a horizontal wellbore at an injection speed;

positioning a bottom hole assembly (BHA) within the horizontal wellbore, the BHA being connected to the coiled tubing string;

monitoring a plurality of sensors connected to the BHA via a communication line positioned within the coiled tubing string, wherein the plurality of sensors comprises a first tension sensor, a second compression sensor, and a third torque sensor;

determining an optimal injection speed of the coiled tubing string by monitoring the plurality of sensors in real-time; and determining in real-time an optimal amount of lubricant within the wellbore to permit the advancement of the BHA along the horizontal wellbore by monitoring the plurality of sensors in real-time.

2. The method of claim 1, further comprising changing the injection speed of the coiled tubing string in real-time based on the real-time determination of the optimal injection speed.

3. The method of claim 2, wherein a vibratory tool is connected to the BHA.

4. The method of claim 3, further comprising powering the vibratory tool via the communication line.

5. The method of claim 3, wherein the plurality of sensors are connected to the vibratory tool.

6. The method of claim 2, wherein a tractor is connected to the BHA.

7. The method of claim 6, further comprising powering the tractor via the communication line.

8. The method of claim 6, wherein the plurality of sensors are connected to the tractor.

9. The method of claim 1, further comprising injecting in real-time the optimal amount of lubricant into the wellbore.

10. The method of claim 1, further comprising powering the sensors via the communication line.

11. The method of claim 1, further comprising determining in real-time whether the coiled tubing string is forming a helix within the wellbore by monitoring the plurality of sensors in real-time.

* * * * *